United States Patent [19]

Tomisawa et al.

[11] 4,036,096

[45] July 19, 1977

[54] MUSICAL TONE WAVESHAPE GENERATOR

[75] Inventors: Norio Tomisawa, Hamamatsu; Yasuji Uchiyama, Hamakita; Takatoshi Okumura; Toshio Takeda, both of Hamamatsu, all of Japan

[73] Assignee: Nippon Gakki Seizo Kabushiki Kaisha, Shizuoka, Japan

[21] Appl. No.: 594,809

[22] Filed: July 10, 1975

[30] Foreign Application Priority Data

| | | |
|---|---|---|
| July 11, 9174 | Japan | 49-79983 |
| July 25, 1974 | Japan | 49-85403 |
| July 25, 1974 | Japan | 49-85404 |

[51] Int. Cl.[2] ..... G10H 1/00; G10H 5/00

[52] U.S. Cl. ..... 84/1.01; 84/1.03; 84/1.22; 235/152; 235/197

[58] Field of Search ..... 84/1.01, 1.03, 1.22; 235/152, 197

[56] References Cited

U.S. PATENT DOCUMENTS

| | | | |
|---|---|---|---|
| 3,515,792 | 6/1970 | Deutsch | 84/1.03 |
| 3,809,786 | 5/1974 | Deutsch | 84/1.01 |
| 3,821,714 | 6/1974 | Tomisawa et al. | 84/1.01 X |
| 3,823,390 | 7/1974 | Tomisawa et al. | 84/1.01 X |
| 3,831,015 | 8/1974 | Hoff, Jr. | 235/197 |
| 3,882,751 | 5/1975 | Tomisawa et al. | 84/1.01 |

*Primary Examiner*—Stanley J. Witkowski

*Attorney, Agent, or Firm*—Spensley, Horn and Lubitz

[57] ABSTRACT

The invention is directed to a waveshape generator capable of producing a desired waveshape by previously storing basic amplitudes obtained by sampling one period of the waveshape at a coarse interval and calculating amplitudes with a fine interval between the basic amplitudes. While basic amplitudes $A$ and $B$ are sequentially produced at a coarse interval in response to an integer portion of the input data, a function $X(c)$ is produced in response to a fraction portion of the input data. Waveshape amplitudes are interpolated between the basic amplitudes by carrying out calculation of $A + (B - A) \times X(c)$ in response to these values $A$, $B$ and $X(c)$. A special form of function $X(c)$ is also used for applying interpolation by a partial waveshape of a trigonometric function wave. An example of a musical tone waveshape generator is also described in which different waveshapes are produced depending upon different tone ranges by moving the position of a radix point for each of the different tone ranges.

13 Claims, 14 Drawing Figures

5
6
54
4 3 5 2 1 0 6 7
56
B
50
52
63
+Vcc
9V
9 7 4 3 2 1 0
51
62
To
A
55
53
5 4 6 2 1 7 0 3
0 1 2 3 4 5 6 7
61
IN (V)
AMPLITUDE
9
8
7
6
5
4
3
2
1
B
A
0 1 2 3 4 5 6 7 0 1 2 3 4
INPUT DATA

DECODER
BASIC VALUE MEMORY
BASIC VALUE MEMORY
DECODER
MSB
LSB
ID
PI
PII
PIII
PIV
AD1
AD2
AD3
AD4
M
M'
C
B
Y
G1
G2
G3
G4
G5
G6
G7
G8
1
2
71
72
73
74
81
82
83

MUSICAL TONE WAVESHAPE GENERATOR

FIELD OF THE INVENTION

This invention relates to a musical tone waveshape generator capable of producing a waveshape signal by calculation of input data.

DESCRIPTION OF THE PRIOR ART

A waveshape memory has been widely used in the past for producing a waveshape signal. One period of a waveshape is sampled by a suitable number and amplitudes (instantaneous values) of the waveshape at respective sample points are previously stored in the waveshape memory. Those amplitudes are sequentially read out in response to their address data. In this prior art waveshape memory, a relatively large number of sampling is required if production of an accurate waveshape is intended, and minimum address data required for this purpose is 10–11 bits. If, for example, the address data consists of 11 bits, sampling number required for one period amounts to 2048 and, acordingly, the memory must store waveshape amplitudes at 2048 sample points. This inevitably requires a memory of a large storge capacity. If a memory storing digitally represented amplitudes, e.g. a read-only memory, is used, minimum amplitude data of 7–8 bits is required and a total bit number of the memory exceeds 10,000 bits. Furthermore, the prior art waveshape memory requires long time for reading of a waveshape because of a large number of bits, consumes a large amount of electric power and requires a high manufacturing cost.

As is well known by the sampling theorem, if a harmonic frequency $f_1$ of a musical tone to be reproduced exceeds half of a sampling frequency $f_2$, folded noise is produced regardless of harmonic ontents of the musical tone due to folded frequency of $f_2 - f_1$. For preventing generation of such folded noise, a musical tone to be stored in the prior art waveshape memory must be one which does not contain excesive harmonic contents. In order to ensure production of a musical tone waveshape which is sufficient for practical uses, one period of waveshape must be sample by a sufficiently large sampling number and, accordingly, a correspondingly large number of addresses (e.g. 10–11 bits) is required. This necessitates a memory of large capacity resulting in extremely high manufacturing cost.

SUMMARY OF THE INVENTION

It is, therefore, an object of the invention to provide a novel musical tone waveshape generator which has eliminated the above described disadvantages of the prior art waveshape generator. According to the invention, a desired waveshape is produced by obtaining amplitudes of the waveshape through calculation of input data, and a waveshape generator which has a compact size and a high response characteristic can be manufactured at a reduced cost.

It is another object of the invention to provide a musical tone waveshape generator capable of producing a musical tone waveshape signal in which an unnecessary harmonic content is restricted and occurence of a folded noise is effectively prevented.

It is another object of the invention to provide a musical tone waveshape generator capable of producing a waveshape in which harmonic contents decrease as the tone pitch rises.

It is still another object of the invention to provide a musical tone waveshape generator capable of producing a waveshape which increasingly resembles a trigonometric function wave as the tone pitch rises.

BRIEF DESCRIPTION OF THE DRAWINGS

These and other objects and features of the invention will become apparent from the description made hereinbelow with reference to the accompanying drawings in which;

FIG. 9(a) is a graphic diagram showing storage contents of basic value memories.

DETAILED DESCRIPTION OF THE INVENTION

Figure 1:
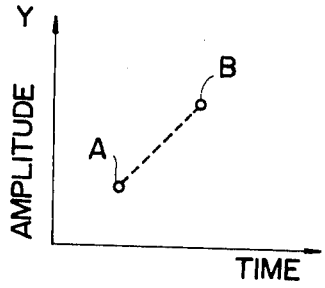
FIG. 1 is a graphic diagram schematically showing a method of interpolation employed in the musical tone waveshape generator according to the invention.

The basic principle of the present invention will first be described with reference to FIG. 1.

If basic amplitudes A and B respectively corresponding to amplitudes of two selected points are given, an amplitude Y between these two points can be interpolated by conducting calculation according to the following equation (1);

$$Y = A + (B - A) \times X(c) \qquad (1)$$

where $X(c)$ represents a function and $C$ represents fraction portion (below radix point) of input data. It is assumed that the equation (1) satisfies a condition $X(c) = 0$ when $C = 0$ and also a condition $X(c) = 1$ when $C = 1$. Accordingly, a function $X(c)$ will suffice if it satisfies a condition $O \leqq X(c) \leqq 1$ when $0 \leqq C \leqq 1$. This function $X(c)$ determines the waveshape between the basic amplitudes $A$ and $B$, so that a suitable form of function can be used in accordance with the waveshape between $A$ and $B$.

Since the basic amplitudes A and B are determined by the integer portion (above radix point) of the input data, fraction portion C between A and B increases from 0 to 1. The input data including the integer portion and the fraction portion gradually increases from 0 to a predetermined value and returns to 0 upon reaching the predetermined value.

Thus, the input data repeats this gradual increase and the period of a generated waveshape is determined by the period of this repetition. The fraction data C itself can be used as the function $X(c)$. In this case, the function is a function of the first degree $X(c) = C$, and a linear interpolation is effected.

Accordingly, the amplitude Y can be calculated by first obtaining the basic amplitudes A and B according to the integer data or obtaining the value A and a value (B − A) as basic values and then conducting calculation according to the equation (1) on the basis of the basic ampltitudes A and B, or the basic values A and (B − A), and the fraction data. According to this method, the amplitude Y is sequentially calculated in accordance with change of the fraction data.

The invention will now be described with reference to a preferred embodiment shown in the accompanying drawings.

Figure 2:
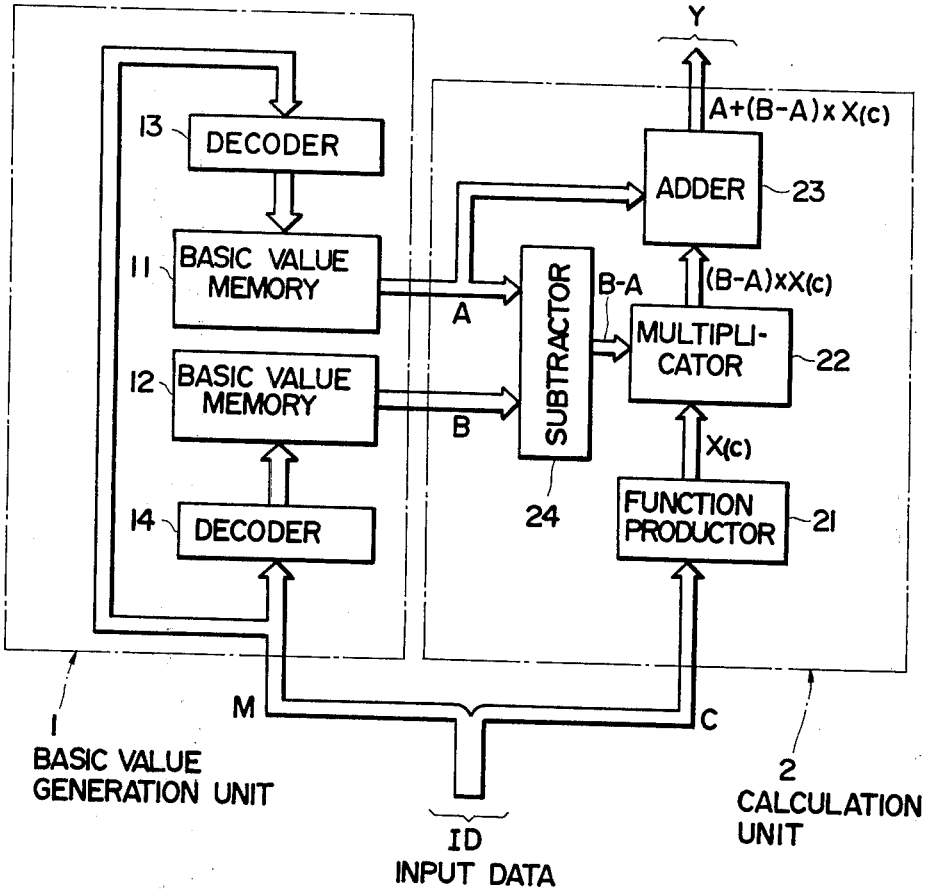
FIG. 2 is a block diagram showing a preferred embodiment of the musical tone waveshape generator.

FIG. 2 is a block diagram showing a preferred embodiment of the waveshape generator according to the invention. Input data ID is digital data (e.g. in binary) consisting of a plurality of digits (e.g. 10 bits) and repeating the gradual increase by a predetermined clock rate from 0 to a predetermined value (e.g. 111111·1111 in binary) as has previously been described. The amplitudes Y at respective time points of a waveshape are sequentially calculated and outputted in accordance with the input data ID. The most significant bit (hereinafter referred to as MSB) and some digits counting from MSB of the input data ID (e.g. 6 bits including MSB) are applied to a basic value generation unit 1 as the integer data M above the radix point whereas the least significant bit (hereinafter referred to as LSB) and the rest of bits from LSB (e.g. 4 bits including LSB) are applied to a calculation unit 2 as the fraction data C below the radix point.

The basic value generation unit 1 comprises a memory originally storing values corresponding to amplitudes at respective sample points obtained by coarsely sampling one period of the waveshape, reads out two amplitude values at two adjacent sample points from this memory in accordance with the integer data M and supplies the read out values to the calculation unit 2 as basic amplitudes A and B.

Basic value memories 11 and 12 store basic amplitudes at respective sample points of one period of the waveshape.

The two memories have entirely the same contents. The contents of the two memories are read out in accordance with values of the integer data M decoded by decoders 13 and 14. If the integer data M consists of 6 bits, the memories 11 and 12 have only to store basic amplitudes at 64 sample. points. Although the integer data M is applied to the decoders 13 and 14 simultaneously, the decoder 14 is so constructed that it will produce an output which precedes (advances) an output of the decoder 13 by one address. Accordingly, an amplitude read from the memory 12 precedes an amplitude read from the memory 11 by one sample point. The output of the memory 11 makes the basic amplitude A and the output of the memory 12 makes the basic amplitude B.

The above arrangement can be achieved by constructing the basic value generation unit 1 in such a manner that the memory 11 has the same construction as the memory 12 and the decoder 13 produces an output corresponding to the integer data M and the decoder 14 produces an output corresponding to a value obtained by adding to the integer data M.

Alternatively, the basic amplitudes may be stored in the two memories in such a manner that the basic amplitudes stored in one of the memories are shifted by one sample point as compared with the basic amplitudes stored in the other.

The calculation unit 2 carries out calculation according to the equation (1) on the basis of the basic amplitudes A and B and the fraction data C. By this calculation, a waveshape amplitude between the basic amplitudes A and B is interpolated and the amplitudes Y obtained by the calculation are sequentially output from the calculation unit 2.

The fraction data C is applied to a function producer 21 and a required function $X(c)$ is output from this function producer 21 in accordance with the fraction data C. The output of the function producer 21 is applied to a multiplicator 22 as a multiplier input. On the other hand, the basic amplitudes A and B are applied to a subtractor 24 which conducts subtraction (B − A). The output (B − A) of the subtractor 24 is applied to the multiplicator 22 as a multiplicand input. The multiplicator 22 conducts multiplication $(B - A) \times X(c)$ and supplies the result of multiplication to an adder 23. The adder 23 receives at another input thereof the basic amplitude A. The adder 23 therefore produces the amplitude value Y which is a result of calculation $A + (B - A) \times X(c)$.

Assumes that the fraction data C consists of LSB and adjacent 3 bits from LSB of the input data ID. While the integer data M maintains a constant value (i.e. the basic values A and B remain unchanged), the fraction data C changes in 16 values, increasing from 0000 to 1111 in binary notation. Accordingly, while the basic amplitudes A and B remain constant, 16 different amplitudes Y are sequentially calculated and output to form waveshape signals in accordance with the change of the fraction data C. Since the basic amplitudes A and B change in 64 values during one period of the gradual increase of the input data ID, one period of the desired waveshape is composed of $64 \times 16 = 1024$ amplitudes. This waveshape is a relatively accurate one obtained by a fine interpolation effected between basic amplitudes which are stored at a coarse interval in the basic value memories 11 and 12.

If a linear interpolation is desired, the function producer 21 is unnecessary and the fraction data C may be directly applied to the multiplicator 22 as the multiplier input.

The basic value memories 11 and 12 and the components of the calculation unit 2 may be either of an analog type or digital type. The amplitude Y is calculated and output in an analog manner or digital manner according to the construction of these component parts.

Figure 3:
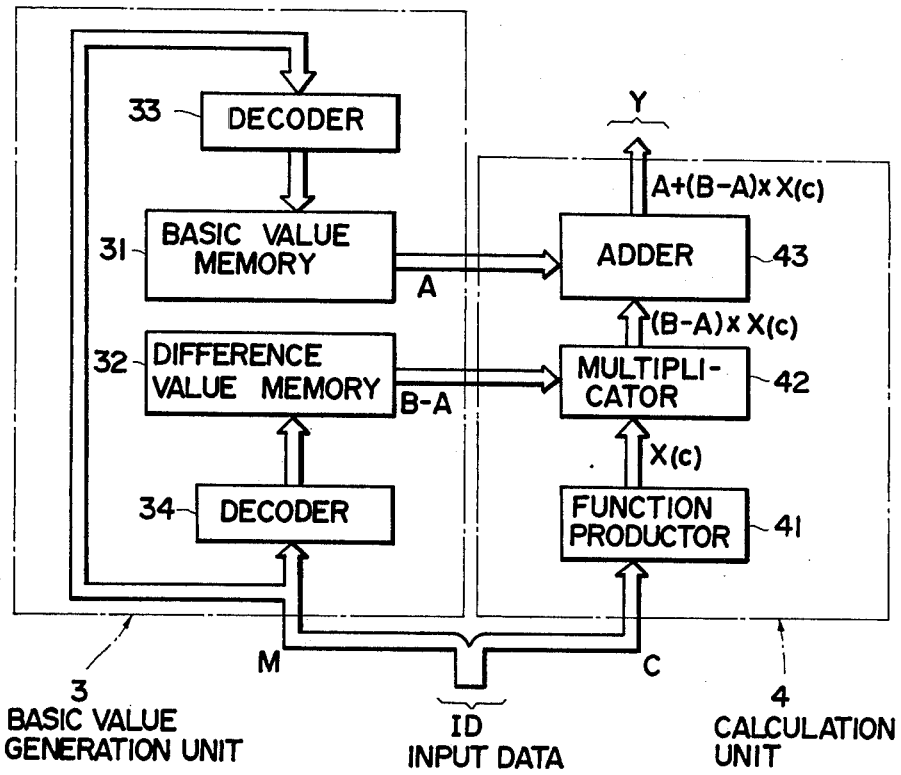
FIG. 3 is a block diagram showing another embodiment of the musical tone waveshape generator.

FIG. 3 is a block diagram showing another embodiment of the invention. In this embodiment, the difference (B − A) in the equation (1) is previously stored in a memory 32. In the same manner as in the previously described embodiment, a series of bits including MSB of input data ID are applied as integer data M to a basic value generation unit 3 and the rest of the bits including LSB of input data ID are applied as fraction data C to a calculation unit 4.

The basic value generation unit 3 comprises a basic value memory 31 which previously stores amplitudes at respective sample points obtained by coarsely sampling one period of a desired waveshape and a difference value memory 32 which previously stores difference between two adjacent basic values stored in the memory 31 (hereinafter referred to as difference value). The basic amplitude A and the difference value B − A are supplied to the calculation unit 4 in accordance with the integer data M.

The integer data M is applied to the memories 31 and 32 through decoders 33 and 34 and used as addresses for reading the contents of the memories 31 and 32. The address for reading a certain amplitude in the memory 31 is the same as the address for reading a difference value between an amplitude at a next sample point and the particular amplitude from the memory 32. Accordingly, the difference value is read from the memory 32. The output of the memory 31 corresponds to the basic value A and the output of the memory 32 to the difference value B − A.

The calculation unit 4 carries out calculation according to the equation (1) on the basis of the basic amplitude A, the difference value B − A and the fraction data C. The calculation unit 4 sequentially produces, upon this calculation, amplitudes Y which interpolate waveshape amplitudes between the two basic values, the waveshape amplitudes being substantially given by the basic amplitude A and the difference value B − A.

In the same manner as has previously been described, the fraction data C is applied to a function producer 41 and a multiplicator 42 carries out calculation $(B - A) \times X(c)$ on the basis of the outputs of the function producer 41 and the difference value memory 32. An adder 43 carries out calculation $A + (B - A) \times X(c)$ on the basis of the outputs of the multiplicator 42 and the basic value memory 31 and produces the amplitudes Y as a result of the calculation. The calculation is continued in accordance with the gradual increase of the integer data M and the fraction data C and the amplitudes Y are sequentially read out to form the desired waveshape. This waveshape is obtained by applying a fine interpolation between the basic amplitudes which are coarsely stored in the basic value memory 31, and has an accurate configuration which is sufficient for a practical use.

In this embodiment too, the component parts may be either of an analog type or a digital type. The present embodiment has a simplified construction in the calculation unit 4 as compared with the embodiment shown in FIG. 2. Moreover, the difference value memory can be constructed with a smaller number of bits than the basic value memory, so that the present embodiment is advantageous in its compactness, manufacturing cost and calculation speed, particularly if the apparatus is constructed of digital components.

Figure 4:
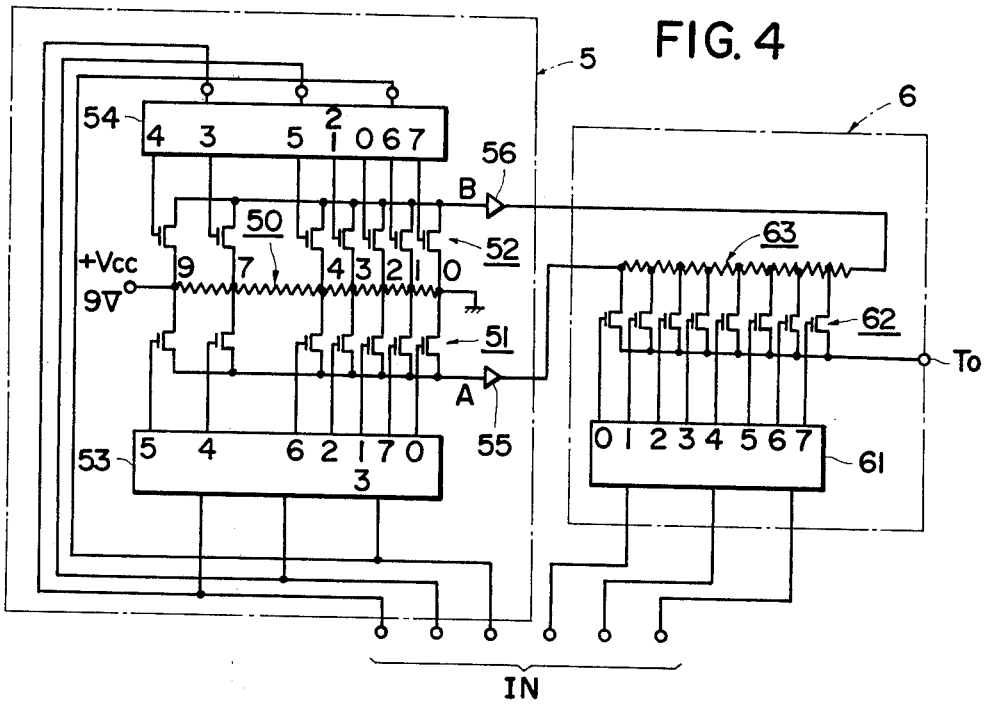
FIG. 4 is a block diagram showing still another embodiment of the musical tone waveshape generator.

FIG. 4 is a circuit diagram showing another embodiment of the invention. In this embodiment, component parts including a basic value and a calculation unit are constructed in an analog by means of semiconductor elements and resistors. Assume that the input data IN consists of 6 bits and MSB and 2 bits from MSB are applied to a basic value generation unit 5 as binary integer data whereas LSB 2 bits from LSB are applied to a calculator 6 as binary fraction data.

The basic value memories for producing the basic amplitudes A and B are analog memories comprising gate circuit 51 and 52 composed of MOS transistors and a voltage dividing circuit 50. Since the contents of the memory which produces the basic amplitude A are the same as the contents of the memory which produces the basic amplitude B, the two memories (the gate circuits 51 and 52) share the voltage dividing circuit 50 for producing voltages corresponding to the basic amplitudes A and B.

Integer data of 3 bits is applied to decoders 53 and 54 and the contents of the basic value memories are read out by the outputs of the decoders 53 and 54. The decoders 53, 54 are of the same construction. Since the integer data consists of 3 bits, there are 8 different decoder outputs. In FIG. 4, numbers 0 - 7 are affixed to decoder outputs corresponding to the respective integer data. For example, an output numbered 6 is produced next to an output numbered 5 in the decoder 53, and contents which are the same as the contents read out by this output numbered 6 are read out by an output numbered 5 in the decoder 54.

The outputs of the decoder 53 are applied to the gates of the MOS transistors constituting the gate circuit 51. The outputs of the decoder 54 are likewise applied to the gates of the MOS transistors constituting the gate circuit 52. The drains of the MOS transistors constituting the gate circuits 51 and 52 are respectively mutually connected in common connection and also connected to corresponding buffer amplifiers 55 and 56. The sources of these MOS transistors are connected to voltage takeout taps of the voltage dividing circuit 50. The voltage dividing circuit 50 is supplied with a suitable power voltage + Vcc, e.g. + 9 V. Value of resistance of a series resistance circuit which constitutes the voltage dividing circuit 50 is divided by 9 and a takeout terminal is provided for each division of the series resistance circuit for taking out of a desired divided voltage output. When selected ones of the MOS transistors are ON, the voltage at the point in the voltage dividing circuit 50 to which the sources of the particular MOS transistors are connected is supplied to a calculation unit 6 through the buffer amplifiers 55 and 56. Gate inputs of these MOS transistors are given in response to the outputs of the decoders 53 and 54 to bring the MOS transistors into conduction. Accordingly, eight different voltages are output in accordance with the decoder outputs.

It will now be understood that one period of a waveshape is coarsely sampled by 8 and the basic amplitudes as the respective sample points are memorized. The above described eight output voltages correspond to these basic amplitudes.

As will be apparent from the foregoing description, the gate circuit 52 produces, when a certain value of the integer data M is applied, a basic amplitude which precedes a basic amplitude produced from the gate circuit 51 by one sample point. The output of the gate circuit 51 corresponds to the basic amplitude A and the output of the gate circuit 52 to the basic amplitude B.

Figure 5:
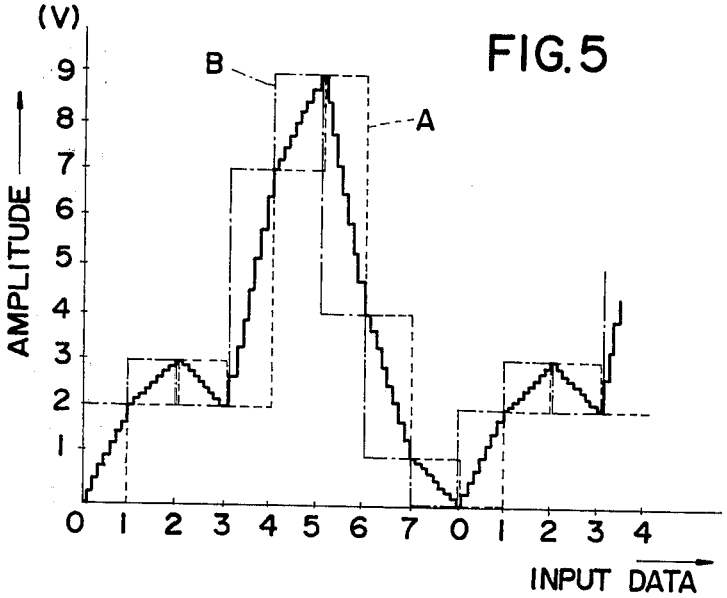
FIG. 5 is a graphic diagram showing outputs of some component parts of the waveshape generator shown in FIG. 4.

FIG. 5 shows relationship between the basic amplitudes A and B in FIG. 4. In FIG. 5, the basic amplitude A is shown by a broken line and the basic amplitude B by a chain line. The abscissa shows gradual increase in the input data and also lapse of time, whereas the ordinate shows values of the basic amplitudes, i.e. the amplitude voltages. When the integer data of the input data is 0, the decoders 53 and 54 produce outputs at the output numbered 0, and the read out basic amplitude A is zero V whereas the basic amplitude B is 2V. When the integer data is 1, the decoders 53, 54 produce outputs at the output numbered 1, and the read out basic amplitudes A and B are 2V and 3V respectively. It will be apparent from the diagram that the basic amplitudes stored at two adjacent sample points are read out as basic amplitudes A and B.

While the integer data maintains a certain constant value, the binary fraction data changes in 8 stages from 000 to 111. The calculation unit 6 carries out calculation according to the equation (1) in an analog manner on the basis of the fraction data and the amplitudes A and B, and applies a linear interpolation between the two basic amplitudes A and B in accordance with the fraction data which changes in 8 stages.

The binary fraction data is applied to a decoder 61 and decoded at addresses 0 - 7. The basic amplitudes A and B are respectively applied to input terminals of a voltage dividing circuit 63 through buffer amplifiers 55 and 56. Accordingly voltage across the series resistance circuit constituting the voltage dividing circuit 63 is B — A. In a case wherein a linear interpolation is applied, resistance of the voltage dividing circuit 63 is equally divided by the number of outputs of the decoder 61 (e.g. 8 as in the present embodiment) and a voltage takeout terminal is provided for each division of resistance. The 8 divided voltage outputs from the voltage dividing circuit 63 respectively correspond to the 8 stages of the fraction data. A gate circuit 62 is provided for obtaining a required divided voltage output in accordance with the gradual change in the fraction data. The gate circuit 62 consists of MOS transistors provided in correspondence to the respective outputs of the decoder 61, the outputs 0 - 7 of the decoder 61 being applied to the gates of these MOS transistors. The drains of the MOS transistors are connected in common connection and also connected to an output terminal To. The sources of the MOS transistors are respectively connected to the voltage takeout terminals (taps) of the voltage dividing circuit 63 to receive the divided voltage outputs, as the fraction data changes gradually and the decoder 61 sequentially produces the outputs 0 - 7, the MOS transistors sequentially become conductive and non-conductive in response to these outputs 0 - 7, sequentially producing divided voltage outputs from the side of the basic amplitude A. These divided voltage outputs constitute waveshape amplitudes.

If function X(*c*) is equal to C in the case of the linear interpolation, the equation (1) is expressed as $$Y = A + (B - A) \times C \quad (2).$$

The voltage dividing circuit 63 and the gate circuit 62 carry out calculation according to the equation (2) and produce the amplitudes Y at the output terminal To as a result of the calculation. The amplitudes Y obtained by this calculation change as shown by a solid line in FIG. 5, and constitute waveshape amplitudes obtained by a fine interpolation between the two basic amplitudes A and B.

If the interpolation is effected by using the function X(*c*), (provided X(*c*) is not equal to C) dividing positions in the voltage dividing circuit 63 may be changed in such a manner that divided voltage outputs will be produced in accordance with the function X(*c*).

In the foregoing equation (1) a suitable function can be selected as the function X(*c*). If, however, a partial waveshape of a trigonometric function wave (sinusoid) which has relatively little harmonic component is interpolated between the basic amplitudes which are obtained by coarsely sampling one period of a waveshape, higher harmonic frequencies in the musical tone are restricted and occurence of an undesirable folded noise can be eliminated. For this purpose, a cosine function or a sine function should preferably be used as the function X(*c*).

Another aspect to be considered in applying interpolation between the basic amplitudes is that a waveshape obtained by the interpolation should resemble a waveshape of a natural musical tone as closely as possible. As will be apparent from comparison of waveshapes shown in FIG. 6(*b*) and FIG. 6(*c*) the waveshape shown in FIG. 6(*b*) is preferable because the top portion of the waveshape more closely resembles a natural waveshape. This waveshape shown in FIG. 6(*b*) changes sharply in the middle portion of the interpolation and rather gradually in the neighborhood of the start and end of the interpolation.

The following cosine function (3) is one example of the function X(*c*) which satisfies both the above described first condition $0 \leqq X(c) \leqq 1$ and the second condition that a waveshape should resemble a natural waveshape as closely as possible:

$$X(c) = \tfrac{1}{2}(1 - \cos \pi C) \quad (3)$$

The waveshape according to the equation (3) is a waveshape produced by inverting a cosine function waveshape between phase angles $0 - \pi$ (i.e. a half period waveshape) so that the amplitude variation will fall between 0 — 1. The function *X*(*c*) may be constructed in other forms by utilizing a trigonometric function such as sine or cosine function so long as the function satisfies the above described first and second conditions and forms a partial waveshape of a trigonometric function wave the middle portion of which changes sharply and the portions in the neighborhood of the start and end of the interpolation change gradually.

Figure 6:
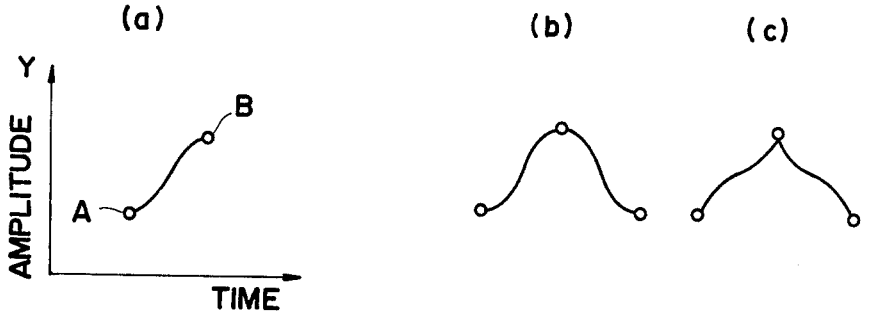
FIGS. 6 (a) through 6(c) are diagrams schematically showing modes of interpolation by partial waveshapes of trigonometric function waveshapes applied between points A and B.

If the interpolation is effected by substituting the equation (3) for the equation (1), a natural waveshape portion between the amplitudes A and B is simulated by a half period cosine waveshape as shown in FIG. 6(*a*).

Figure 7:
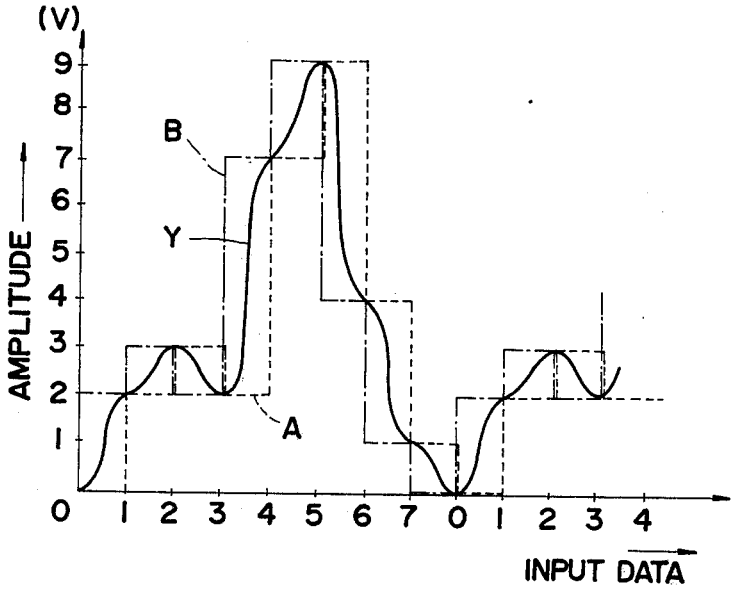
FIG. 7 is a graphic diagram showing one example of output waveshape produced when the interpolation shown in FIG. 6(*b*) is applied to the basic amplitudes shown in FIG. 4.

FIG. 7 is a graphic diagram showing one example of an interpolated waveshape obtained in a case wherein the function X(*c*) takes the form of the equation (3) and the change of the basic amplitudes A and B. In the diagram, the basic amplitude A is shown by a broken line. The abscissa indicates the sequential change of the input data ID and also lapse of time, whereas the ordinate indicates values of the basic amplitudes, i.e. amplitude voltages.

Figure 8:
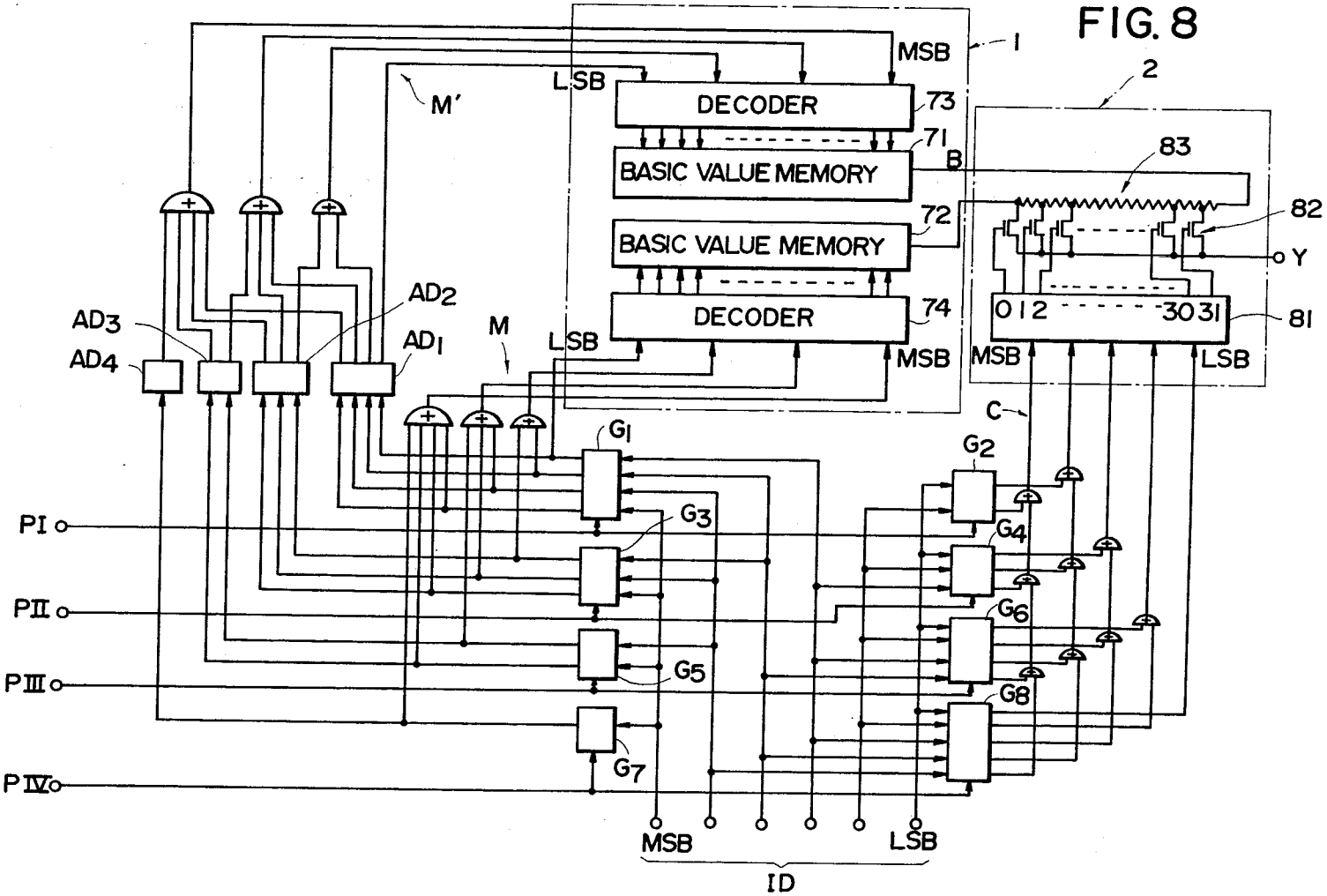
FIG. 8 is a block diagram showing another embodiment of the musical tone waveshape generator according to the invention in which waveshapes having different harmonic contents are produced in accordance with four different contents are produced in accordance with four different tone ranges.

FIG. 8 is a block diagram showing another embodiment of the invention. According to this embodiment, different waveshapes are produced depending upon tone frequency ranges. The position of radix point in the input data changes in accordance with a tone range to which a note of a depressed key belongs thereby to change values of integer and fraction data. Thus, states of basic amplitudes in one period of a waveshape vary depending upon tone ranges. The construction of this embodiment in other respects are the same as the previously described embodiments so that description thereof will be omitted.

Referring to FIG. 8, input data ID consists of a suitable number of binary digits, e.g. 6 bits. Amplitudes Y at respective sample points of a musical tone waveshape to be reproduced are sequentially calculated and output in response to the input data ID. In the embodiment shown in FIG. 8, four tone ranges are employed. The first and second octaves (counting from the lowest pitch) are referred to as a tone range I, the third octave a tone range II, the fourth octave a tone range III and the fifth octave a tone range IV respectively. The binary point placed in the input data ID is moved between four states corresponding to these four tone ranges. In the figure, reference characters MSB designate the most significant bit as LSB the least significant bit.

The binary point in the input data ID corresponding to the tone range I is placed at a position where LSB and the next bit become a binary fraction portion and four other bits including MSB become a binary integer portion. The fraction portion is supplied through a gate circuit $G_2$ and the integer portion through a gate circuit $G_1$. The binary point for the tone range II is placed at a position where LSB and the first and second bits from LSB constitute a fraction portion and MSB and the first and second bits from MSB constitute an integer portion. The fraction portion is output through a gate circuit $G_4$ and the integer portion through a gate circuit $G_3$. The binary point corresponding to the tone range III is placed at a position where LSB and the first, second and third bits from LSB constitute a fraction portion and MSB and the next bit constitute an integer portion. The fraction portion is output through a gate circuit $G_6$ and the integer portion through a gate circuit $G_5$. Similarly, the binary point corresponding to the tone range IV is placed at a position where LSB and the first through fourth bits from LSB constitute a fraction portion and MSB constituted an integer portion. The fraction portion is output through gate circuit $G_8$ and the integer portion through a gate circuit $G_7$. As the tone pitch becomes higher, the position of the binary point moves up and variation in the integer portion for one period of the waveform becomes smaller.

The gate circuits $G_1$ – $G_8$ corresponding to the tone ranges I–IV become ON by application thereto of signals PI – PIV each of which represents the fact that a key belonging to a particular tone range is being depressed (i.e. a signal corresponding to a tone range to which a key corresponding to the input data ID belongs), enabling fraction data C and integer data M divided at a predetermined binary position to be output through OR circuits connected to these gate circuits. The integer data M consists of 4 bits and less significant bits among these bits which have ceased to exist because of moving up of the binary point always produce "0". In other words, a gate circuit for one particular tone range only is open at a certain same time point and outputs of the other gate circuits are all "0". In the tone range IV, for example, one bit which is the output of the gate $G_7$ becomes MSB of the integer data M and three other bits are always fixed at "0". The fraction data C consists of 5 bits, output from the gate circuits constituting the fraction data C in the order starting from its most significant bit toward less significant bits. In the tone range I, for example, LSB and the next bit of the input data ID which are output from the gate circuit $G_2$ become MSB and the next bit of the fraction data C and the rest of the bits of the fraction data are always fixed at "0".

The integer data M of the input data ID in which the position of the binary point has been switched in response to the signals PI–PIV indicating the tone frequency ranges to which the depressed key belongs is applied to a basic value generation unit 1, whereas the fraction data C is applied to a calculation unit 2.

The basic value generation unit 1 comprises memories 72 and 71 which previously store a plurality of basic amplitudes. Two sequential basic amplitudes A and B are read from these memories and supplied to the calculation unit 2.

The basic amplitudes coarsely determine one period of a desired waveshape. Although it is desirable that a musical tone waveshape to be used as a tone source should contain sufficient harmonic components, high harmonic frequencies which will produce a folded noise is unnecessary. In order to satisfy the two conditions, the produced waveshape have sufficient harmonic contents in low tone ranges and little harmonic contents in high tone ranges.

If, for example, saw-tooth waveshape is stored in the memory, this waveshape is directly read out in a range of low tones, whereas it is modified in a range of high tones in such a manner that it will resemble a triangular wave which has little harmonic content or a sine wave which has no harmonic content at all.

The basic value memories 71 and 72 store basic amplitudes capable of coarsely forming a desired waveshape.

Figure 9:
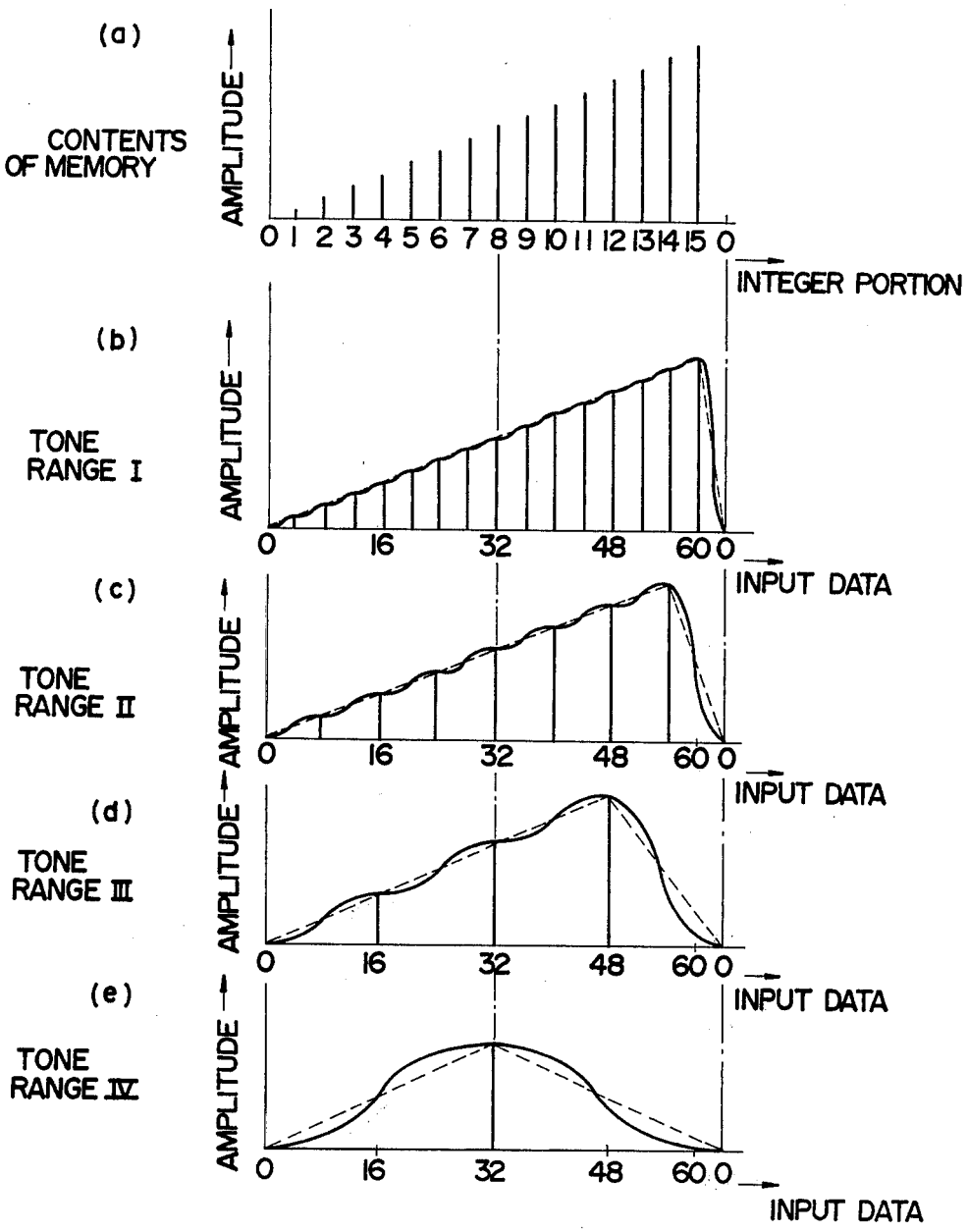
FIG. 9(*b*) through 9(*e*) are graphic diagrams showing the output waveshapes of the waveshape generator shown in FIG. 8 in the respective tone ranges.

If a saw-tooth waveshape is stored in the memories 72 and 71, sixteen basic amplitudes as shown in FIG. 9(*a*) are stored in accordance with values 0 – 15 of the 4 - bit integer data. Different waveshapes are produced by changing the manner of reading of these basic amplitudes in one period. If, for example, all of the basic amplitudes 0 – 15 are sequentially read out, these basic amplitudes will constitute a saw-tooth waveshape. If the basic amplitudes at the time points 0 and 8 only are read out, they will constitute a triangular wave or a sine (or cosine) wave. This change in the manner of reading is achieved by changing the position of the binary point in the input data ID and thereby changing the states of change of the integer data M for one period.

In the tone range I, while the 6-bit input data ID changes in 64 different states in one period, the integer data changes in 16 different states from 0 – 15, thereby coarsely forming a saw-tooth waveshape by sampling one period by the 16 basic amplitudes as shown in FIG. 9(*b*). In the tone range II, the integer data which has passed through the gate circuit $G_3$ has undergone change in the state of MSB and th first and second bits from MSB so that it changes in 8 states, i.e. 0, 2, 4, 6, 8, 10, 12, 14 as shown in FIG. 9(*a*), thereby sampling one period of waveshape by the 8 basic amplitudes as shown in FIG. 9(*c*). In the tone range III, the integer data having passing the gate circuit $G_5$ has undergone change in MSB and the next bit, so that it changes in 4 states, i.e. 0, 4, 8, and 12 as shown in FIG. 9(*a*), thereby sampling one period of waveshape by the 4 basic amplitudes as shown in FIG. 9(*d*). In the tone range IV, the integer data changes in MSB only so that it changes in two states, i.e. 0 and 8 as shown in FIG. 9(*a*), thereby sampling one period by the two basic amplitudes as shown in FIG. 9(*a*). It will be noted that the states of the basic amplitudes change depending upon the tone range.

In order to obtain the two sequentially produced amplitudes A and B simultaneously, basic value memories 72, 71 and decoders 74, 73 are provided. The respective pair of those components have the same construction and storage contents. The memory 72 is addressed by integer data M for obtaining the basic amplitude A and the memory 71 is addressed by integer data M′ for obtaining the basic amplitude B. The integer data M′ corresponds to a value which the integer M takes in a next state. Accordingly, the amplitude B which immediately follows the amplitude A in its order of occurrence is always read from the memory 71 which is addressed by the integer data M'.

The integer data M' is obtained by previously converting the outputs of the gate circuits $G_1$, $G_3$, $G_5$ and $G_7$ to values which are output in a next state. More specifically, since the integer data sequentially increases, the outputs of the gate circuits $G_1$, $G_3$, $G_5$ and $G_7$ are respectively applied to corresponding "1" addresses $AD_1$ – $AD_4$ for adding "1" to the integer data. The integer data thereafter is applied to OR circuits where it is multiplexed by each bit to form the integer data M'.

Signals similar to the tone range signals PI – PIV are applied to the 1 adders $AD_1$ – $AD_4$ so that 1 is added only to data of the tone range corresponding to the input data ID. In the case of the tone range III, for example, if the output of the gate circuit $G_5$ is 01, the 1 adder $AD_3$ only performs the addition of 1 and produces an output 10. Since outputs of the other adders are all 0, these outputs are multiplexed by each bit in the OR circuits and constitute the integer data M' of 1000. At this time, the integer data M is 0100 so that the basic amplitudes at the integers 4 and 8 in FIG. 9(*a*) are read from the memories 71 and 72. In this manner, the basic amplitudes A and B are simultaneously read out.

The calculation unit 2 carries out calculation according to the equation (1) on the basis of the basic amplitudes A and B and the fraction data C for applying interpolation between the basic amplitudes with the waveshape amplitudes Y. In the present embodiment, the basic amplitudes are provided by voltage and the calculation unit 2 is constructed as an analog type device.

Since the binary fraction data C consists of 5 bits, the fraction data C can change in 32 states while the integer data M maintains a certain constant value. There is, however, a case where MSB and some adjacent bits only change by moving of the binary point. For example, the fraction data C changes in four states in the tone range I, eight states in the tone range II, sixteen states in the tone range III and 32 states in the tone range IV. This is because the fraction data C is formed with MSB, or MSB and some other adjacent bits, and the rest of the bits are always fixed at 0, as has previously been described. The fraction data C is applied to a decoder 81 which produces an output at an address among addresses 0 – 31 corresponding to the value of the decimal fraction data C.

The basic amplitudes A and B are applied to input terminals of a voltage dividing circuit 83. Voltage drop between the input terminals of the voltage dividing circuit 83 therefore is B – A. Divided voltage outputs at respective dividing points in this circuit are commonly provided as the amplitude outputs Y from a gate circuit 82 consisting of a plurality of MOS transistors which are gate-controlled by the outputs off the decoder 81. Accordingly, the series resistance of the voltage dividing circuit 83 is divided by 32 in correspondence to the fraction data C, and the ratio of the divided resistance is determined by the function $X(c)$. For example, the series resistance is equally divided by 32 in the case of a linear interpolation. In the case of interpolation by a cosine wave, the series resistance is divided by 32 in accordance with values of the function $X(c)$ corresponding to 32 states within the range of $0 \leqq C \leqq 1$ in the equation (3). The 32 states respectively correspond to 32 values of the fraction data C.

In the tone range I, while the basic amplitudes A and B maintain constant values, the fraction data C coarsely change in 4 states and the MOS transistors corresponding to the outputs of addresses of the decoder 81, e.g. addresses 0, 8, 16, and 24 sequentially become conductive and non-conductive. In the tone range II, the fraction data C changes in 8 states and the MOS transistors corresponding to the outputs of addresses 0, 4, 8, 12 . . . . . 28 of the decoder 81 sequentially become conductive and non-conductive in response to the outputs of the decoder 81 and corresponding voltage divided outputs are sequentially output as the waveshape amplitudes Y. In the tone range IV where sampling of the basic amplitudes for one period is the coarest, all of the 32 outpus of the decoder 81 are sequentially produced whereby a fine interpolation is applied between the basic amplitudes.

Calculation according to the equation (1) is carried out in the calculation unit 2. In the case of a linear interpolation, waveshapes as shown by broken lines in FIGS. 9(*b*) – 9(*e*) are obtained for each of the tone ranges. In the tone range I where pitches are low, a complete saw-tooth waveshape is obtained. As the pitch becomes higher, the produced waveshape comes closer to a triangular waveshape until it becomes a complete triangular waveshape in the tone range IV. If the interpolation is effected by a half period waveshape of a cosine wave as expressed by the above described equation (3), waveshape as shown by solid lines in FIGS. 9(*b*) – 9(*e*) are produced. In the tone range I there are relatively large number of basic amplitudes and these basic amplitudes are coarsely interpolated so that very little effect is exercised by the cosine waveshape and the produced waveshape assumes a waveshape of a substantially complete saw-tooth waveshape. As the pitch increases, the cosine waveshape exercises more influence to the produced waveshape, thereby restricting harmonic contents. In the tone range IV, one period is composed of two half period cosine waveshapes, so that the produced waveshape assumes a complete cosine waveshape (a trigonometric function waveshape), resulting in complete elimination of harminic contents.

In this embodiment, the range of tones is divided into four tone ranges but the tone range may be divided into any desired number of ranges in accordance with the bit number of the input data. In a case wherein feet is changed, the fundamental wave frequency of each key is changed by each octave so that the waveshape of the particular tone range is substantially determined not by the kind of the key but by the value of the fundamental wave frequency.

The present embodiment is so constructed that the basic amplitudes A and B and the waveshape amplitude Y may be produced in an analog manner. The invention is not limited to this but the basic value memories 72, 71 and the calculation unit 2 may be digitally constructed to produce waveshape amplitudes in digital representation. In this case, the calculation unit 2 must comprise digital type adders, multiplicators and function producers to carry out the calculation according to the equation (1). It is also possible to have one of the basic value memories store a difference value B – A for each tone range. In the example shown in FIG. 8, for example, the capacity of the memory can be saved by having it store the difference value for each tone range, since the difference value between the respective basic values is equal to each to each other. This arrangement has an advantage that the calculation conducted in the calculation unit 2 can be simplified.

What is claimed is:

1. A waveshape generator for generating waveshapes, for conversion into musical tones from input data consisting of plural digits and sequentially and repetitively changing in number, said waveshape generator comprising: first means having said data coupled thereto and including a first and second memory each storing a plurality of basic amplitudes obtained by sampling one period of a waveshape at a coarse interval and a read out circuitry for producing two sequentially occurring basic amplitudes A and B in response to the value of most significant digits of the input data; and calculation means connected to said first means and receiving said input data and conducting calculation "$A + (B - A) \times X(c)$" where $X(c)$ is a selected function whose value is determined by a fraction portion $C$ represented by least significant digits of the input as variables (provided $0 = \leqq X(c) \leqq 1$), waveshape amplitudes between the basic amplitudes A and B being sequentially calculated and output in response to the change in the value of said fraction portion C.

2. A waveshape generator for generating waveshapes for conversion into musical tones as defined in claim 1 wherein said function X(c) is one half $(1 - \cos \pi C)$.

3. A waveshape generator for generating waveshapes for conversion into musical tones as defined in claim 1 wherein said first means further comprises first and second decoders respectively provided in correspondence to said first and second memories for respectively reading the basic amplitudes A and B respectively from said first and second memories in response to the value of more significant digits of the input data.

4. A waveshape generator for generating waveshapes for conversion into musical tones as defined in claim 1 wherein said calculation means comprises a subtracter for carrying out substraction B − A, a function producer for producing a desired function X(c) in response to the fraction portion C and a multiplicator for multiplying the output of said substractor with the output of said function producer and an adder for adding the output of said multiplicator and the basic amplitude A together.

5. A waveshape generator for generating waveshapes for conversion into musical tones as defined in claim 1 wherein said first means comprises a network for producing voltages corresponding to the basic amplitudes and a first and second gate circuits which are gate-controlled in response to the value of the more significant digits of the input data thereby to control production of voltages and produce two sequentially occurring basic amplitudes A and B in response to the value of the more significant digits and said calculation means comprise a voltage dividing circuit which receives at input terminal the voltage representing the basic amplitude A and the other input terminal thereof the voltage representing the basic amplitude B thereby to produce a voltage drop equal to a difference (B − A) between the two input terminals and produce voltage divided outputs with a desired voltage dividing ratio, and a third gate circuit which is gate-controlled in response to the value of the fraction portion of the input data to control production of the voltage divided output and produces output voltages from said voltage dividing circuit with a voltage dividing ratio corresponding to the value of the fraction portion, waveshape amplitudes voltages between the basic amplitudes A and B regulator in accordance with the set voltage dividing ratio in said voltage dividing circuit being sequentially output in accordance with the change in the value of the more significant digits.

6. A waveshape generator for generating waveshapes for conversion into musical tones as defined in claim 1 which further comprises gate control means for changing the position of a radix point defining a border between the most significant digits and the least significant digits in the input data consisting of a plurality of digits for each of a plurality of tone ranges, thereby producing waveshapes which have different harmonic contents.

7. A waveshape generator for generating waveshapes for conversion into musical tones as defined in claim 6 wherein said gate control means comprises a plurality of gate circuits which move up the position of the radix point as the tone range becomes higher.

8. A waveshape generator for generating waveshapes for conversion into musical tones from input data consisting of plural digits and sequentially and repetitively changing in number, said waveshape generator comprising:

a first means having said input data coupled thereto and including a first and second memory, said first memory storing a plurality of basic amplitudes A obtained by sampling one period of a desired waveshape at a coarse interval and said second memory storing a plurality of difference values between two sequentially occurring basic amplitudes (B − A) and a readout circuitry for producing said basic amplitudes A and difference values (B − A) in response to the most significant digits of said input data; and a calculation means connected to said first means and having said input data coupled thereto and conducting calculation "A + (B − A) times × (c)" where X(c) is a selected function whose value is determined by fraction portion C represented by the less significant digits of the input data as variables provided $0 = X(c) = 1$), waveshape amplitudes between the basic amplitudes A and B being sequentially calculated and output in response the change in the value of said fraction portion C.

9. A waveshape generator for generating waveshapes for conversion into musical tones as defined in Claim 8 wherein said function X(c) is one half $(1 - \cos\pi C)$.

10. A waveshape generator for generating waveshapes for conversion into musical tones as defined in claim 8 wherein said first means further comprises first and second decoders provided in correspondece to said first and second memories for reading the basic amplitude A and the difference value (B − A) from said first and second memories in response to the value of the more significant digits of the input data.

11. A waveshape generator for generating waveshapes for conversion into musical tones as defined in claim 8 wherein said calculation means comprises a function producer for producing a desired function X(c) in response to the fraction portion C and a multiplicator for multiplying the output (B − A) of said second memory with the output of said function producer and an adder for adding the output of the multiplicator and the output of said first memory together.

12. A waveshape generator for generating waveshapes for conversion into musical tones as defined in claim 8 which further comprises a gate control means for changing the position of the radix in the input data consisting of a plurality of digits for each of a plurality of tone ranges, thereby producing waveshapes which have different harmonic contents.

13. A waveshape generator for generating waveshapes for conversion into musical tones as defined in claim 12 wherein said gate control means comprises a plurality of gate circuits which move up the position of the radix point as the tone range becomes higher.

* * * * *

UNITED STATES PATENT AND TRADEMARK OFFICE

CERTIFICATE OF CORRECTION

PATENT NO. : 4,036,096

DATED : July 19, 1977

INVENTOR(S) : Norio Tomisawa; Yasuji Uchiyama; Takatoshi Okumura; Toshio Takeda

It is certified that error appears in the above-identified patent and that said Letters Patent are hereby corrected as shown below:

Column 13, line 19, delete "=".

Column 14, line 31, change "×" to --X--.

Column 14, line 35, change "=" to -- ≦ --, both occurrences.

Signed and Sealed this

*Third* Day of *January 1984*

[SEAL]

*Attest:*

GERALD J. MOSSINGHOFF

*Attesting Officer*

*Commissioner of Patents and Trademarks*